US007963365B2

(12) United States Patent
Grilliot et al.

(10) Patent No.: US 7,963,365 B2
(45) Date of Patent: Jun. 21, 2011

(54) DRAG HARNESS IMPROVEMENTS

(75) Inventors: William L. Grilliot, Dayton, OH (US); Mary I. Grilliot, Dayton, OH (US)

(73) Assignee: Morning Pride Manufacturing, L.L.C., Dayton, OH (US)

( * ) Notice: Subject to any disclaimer, the term of this patent is extended or adjusted under 35 U.S.C. 154(b) by 0 days.

(21) Appl. No.: 11/525,612

(22) Filed: Sep. 22, 2006

(65) Prior Publication Data

US 2007/0012513 A1 Jan. 18, 2007

Related U.S. Application Data

(60) Division of application No. 11/135,082, filed on May 23, 2005, which is a continuation-in-part of application No. 10/772,560, filed on Feb. 5, 2004.

(51) Int. Cl.
*A62B 35/00* (2006.01)

(52) U.S. Cl. ..... 182/3

(58) Field of Classification Search ..... 182/3
See application file for complete search history.

(56) References Cited

U.S. PATENT DOCUMENTS

| | | | | |
|---|---|---|---|---|
| 2,568,304 | A * | 9/1951 | Schoenbrun | 119/770 |
| 2,592,771 | A | 4/1952 | Wampler | |
| 2,931,629 | A * | 4/1960 | Keller | 254/409 |
| 2,956,541 | A | 10/1960 | Rall | |
| 3,176,793 | A * | 4/1965 | Hlacia | 182/3 |
| 3,701,559 | A * | 10/1972 | Marino et al. | 294/74 |
| 3,972,238 | A * | 8/1976 | Thatcher | 482/128 |
| 4,079,933 | A * | 3/1978 | Everroad | 482/140 |
| 4,121,688 | A * | 10/1978 | Lirakis | 182/3 |
| 4,324,205 | A * | 4/1982 | Goldmacher | 2/300 |
| 4,341,285 | A | 7/1982 | Krickovich | |
| 4,396,091 | A | 8/1983 | Anderson | |
| 4,682,671 | A | 7/1987 | Hengstenberg et al. | |
| 4,834,439 | A * | 5/1989 | van de Kamp | 294/74 |
| 4,854,418 | A | 8/1989 | Hengstenberg et al. | |
| 5,253,657 | A | 10/1993 | Butterfield | |
| 5,388,551 | A * | 2/1995 | Martusciello | 119/770 |
| 5,619,955 | A * | 4/1997 | Nelson | 119/857 |
| 6,205,584 | B1 | 3/2001 | Yocco | |
| 6,244,379 | B1 | 6/2001 | Larson | |
| 6,276,006 | B1 * | 8/2001 | Hoit | 5/81.1 R |
| 6,397,784 | B1 | 6/2002 | Morgan-Albertson et al. | |
| 6,641,008 | B2 * | 11/2003 | Falzone et al. | 224/157 |
| 7,216,908 | B2 * | 5/2007 | Daigle | 294/74 |
| 2002/0005175 | A1 * | 1/2002 | Donovan et al. | 119/798 |
| 2004/0128734 | A1 | 7/2004 | Jordan | |
| 2004/0182644 | A1 * | 9/2004 | Kotarski | 182/3 |
| 2005/0103813 | A1 * | 5/2005 | Edwards | 224/157 |

FOREIGN PATENT DOCUMENTS

FR 2655637 A1 6/1991

* cited by examiner

*Primary Examiner* — Alvin C Chin-Shue
(74) *Attorney, Agent, or Firm* — Wood, Phillips, Katz, Clark & Mortimer

(57) ABSTRACT

A drag harness comprises two arm loops, each of which has a fixed length and is adapted to receive a separate arm of a wearer, and a pair of gripping loops, each of which has a fixed length. The gripping loops are joined to the arm loops.

4 Claims, 1 Drawing Sheet

DRAG HARNESS IMPROVEMENTS

CROSS-REFERENCE TO RELATED APPLICATIONS

This application is a division of U.S. patent application Ser. No. 11/135,082, which was filed on May 23, 2005. U.S. patent application Ser. No. 11/135,082 was filed as a continuation-in-part of U.S. patent application Ser. No. 10/772,560, which was filed on Feb. 5, 2004, and which was published as U.S. Patent Application Publication No. US 2005/0173188 A1 on Aug. 11, 2005. U.S. patent application Ser. No. 11/135,082 incorporates by reference the disclosure of U.S. patent application Ser. No. 10/772,560.

TECHNICAL FIELD OF THE INVENTION

This invention pertains to a drag harness of a type used by a rescuer, such as a firefighter, to drag a wearer lying in a supine position, from a perilous situation.

BACKGROUND OF THE INVENTION

As exemplified in U.S. Pat. Nos. 4,682,671, 4,854,418, and 6,205,584 B1, and in U.S. patent application Ser. No. 10/772,560, supra, and as known heretofore, drag harnesses of the type noted above have arm loops made from strapping or webbing, which tends excessively to abrade adjacent cloth, such as cloth linings of protective coats worn over such harnesses.

As exemplified therein, drag harnesses of the type noted above have gripping means comprising single loops, which can be very difficult for a rescuer to grasp with two hands or with two arms or for two rescuers to grasp. If the wearer is heavy or is laden with heavy gear, it may be quite difficult for a rescuer grasping such a loop with one hand or with one arm to drag the wearer.

SUMMARY OF THE INVENTION

According to a first aspect of this invention, this invention provides in a drag harness comprising two arm loops, each of which is adapted to receive a separate arm of a wearer, and gripping means joined to the arm loops, whereby a rescuer grasping the gripping means can drag the wearer, via the drag harness, if the wearer is lying in a supine position, an improvement wherein the arm loops are made from a non-abrading material. The non-abrading material may be a filamentary material, such as nylon rope or polyester rope, or may be cotton rope or other similarly soft rope. The non-abrading material may be or may be a material, such as strapping, webbing, or rope, which has a surface finish providing the material with a non-abrading characteristic. Preferably, the gripping means is made from strapping or webbing and comprises a single gripping loop or a pair of gripping loops. Preferably, moreover, each gripping loop of the gripping means has a fixed length.

According to a second aspect of this invention, this invention provides in a drag harness comprising two arm loops, each of which is adapted to receive a separate arm of a wearer, and gripping means joined to the arm loops, whereby a rescuer grasping the gripping means can drag the wearer, via the drag harness, if the wearer is lying in a supine position, an improvement wherein the gripping means comprises plural gripping loops, preferably a pair of gripping loops but conceivably three or more gripping loops. Preferably, whether made from rope, from strapping or webbing, or from other material, each of the arm loops has a fixed length. Preferably, each of the gripping loops of the gripping means has a fixed length.

The first and second aspects of this invention can be advantageously combined in a drag harness.

DETAILED DESCRIPTION OF THE ILLUSTRATED EMBODIMENTS

Figure 1:
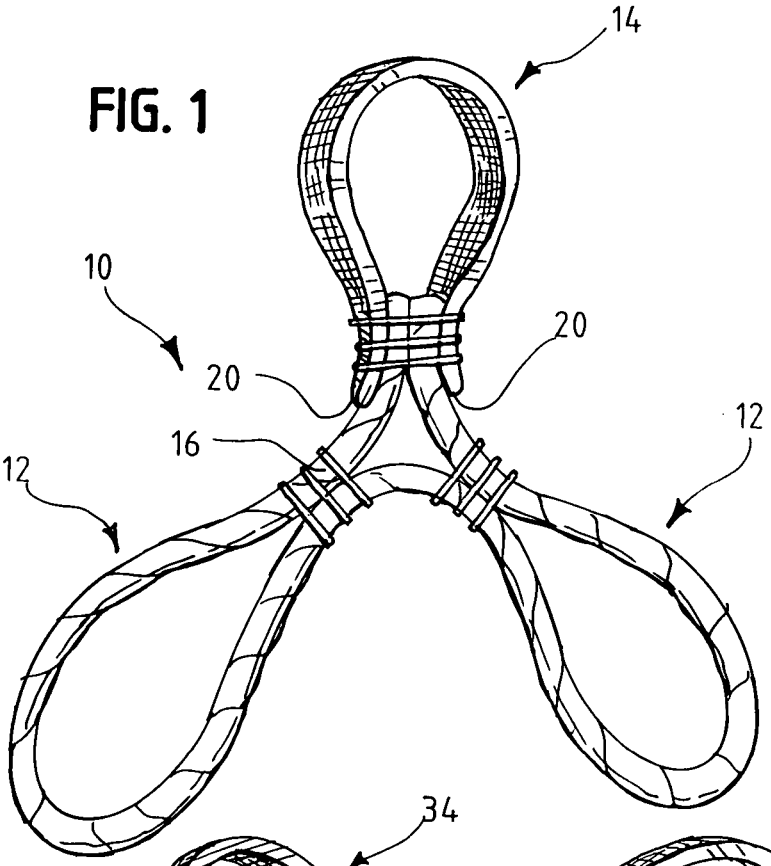
FIG. 1 is a pictorial view of a drag harness embodying the first aspect of this invention.

As illustrated in FIG. 1, a drag harness 10 embodies the first aspect of this invention. Except as illustrated and described herein, the drag harness is similar to the drag harness illustrated and described in U.S. patent application Ser. No. 10/772,560, supra, and is utilized similarly.

The drag harness 10 comprising two arm loops 12, each of which has a fixed length and is adapted to receive a separate arm of a wearer, and gripping means joined to the arm loops 12, whereby a rescuer grasping the gripping means can drag the wearer, via the drag harness 10, if the wearer is lying in a supine position. The gripping means comprises a single gripping loop 14, which is made from strapping or webbing and which has a fixed length.

As contemplated by this invention, the arm loops 12 are made from a non-abrading material, which is illustrated as rope. The non-abrading material may be filamentary rope, such as filamentary Kevlar™ rope or filamentary Nomex™ rope, or may be cotton rope or other similarly soft rope. The non-abrading material may be material, such as strapping, webbing, or rope, which has a non-abrading surface or which has a surface finish, such as a Teflon™ polytetrafluoroethylene finish or another suitable finish, which provides the material with a non-abrading surface. Herein, non-abrading means having a minimal tendency to abrade adjacent cloth, such as a cloth liner of a protective coat worn over the arm loops 12 of the drag harness 10.

As illustrated, the arm loops 12 are provided by the non-abrading material in a single length, which is deployed across itself at two crossings 16 and which is attached to itself at the crossings 16, by stitching and lashing, so as to define the arm loops 12 and so as to provide that each arm loop 12 has a fixed length. Each end 18 of the single length of the non-abrading material is attached, by stitching and lashing, to one end 20 of the single loop 14.

Figure 2:
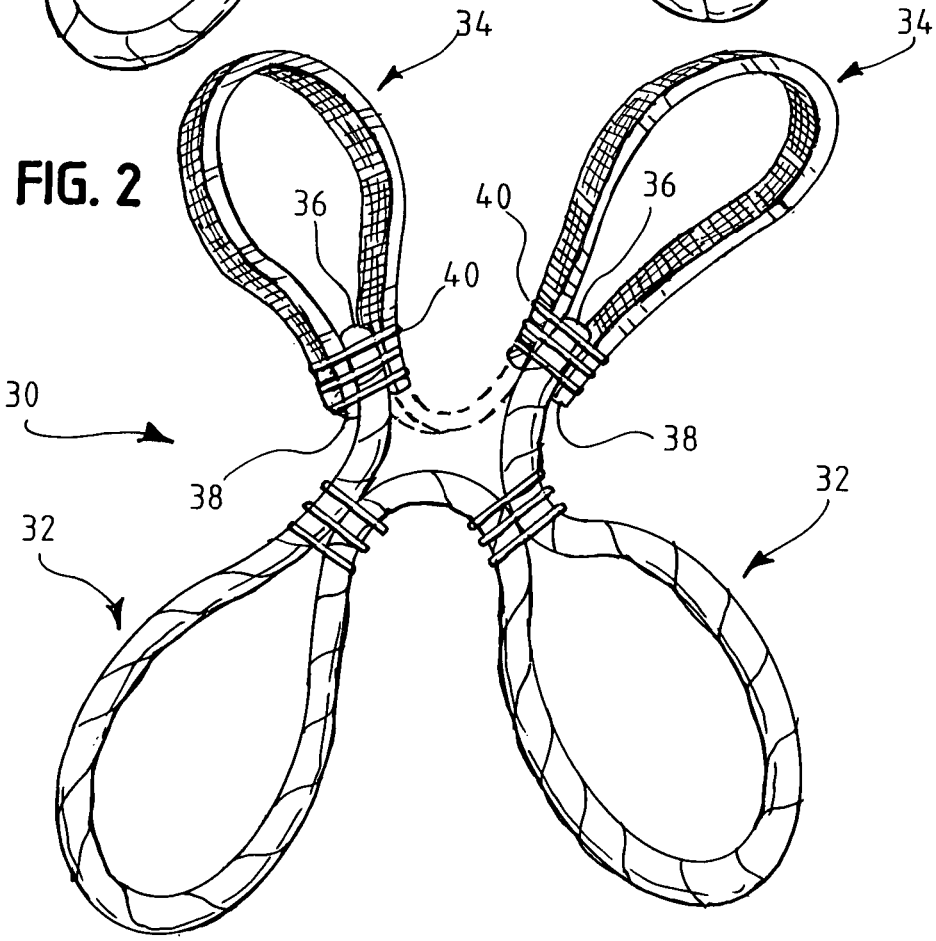
FIG. 2 is a pictorial view of a drag harness embodying the second aspect of this invention, as well as the first aspect of this invention.

As illustrated in FIG. 2, a drag harness 30 embodies the second aspect of this invention, as well as the first aspect of this invention. Except as illustrated and described herein, the drag harness is similar to the drag harness 10 and to the drag harness illustrated and described in U.S. patent application Ser. No. 10/772,560, supra, and is utilized similarly.

The drag harness 30 comprises two arm loops 32, which are similar to the arm loops 12 of the drag harness 10 and which, as illustrated, are made from a single length of soft rope, and a pair of gripping loops 34, which are made from a single length of strapping or webbing. Each end 36 of the single length of soft rope used for the arm loops 32 is attached, by stitching and lashing, to one end 38 of the single length of strapping or webbing used for the pair of gripping loops 34 and to an intermediate portion 40 of the single length of strapping or webbing used for the pair of gripping loops 34, so as to define the pair of gripping loops 34 and so as to provide for each gripping loop 34 to have a fixed length.

Thus, a rescuer can grasp a separate one of the gripping loops 34 with each hand or with each arm or two rescuers can work together, each grasping a separate one of the gripping loops 34 with one hand or with one arm, so as to facilitate dragging a heavy wearer or a wearer laden with heavy gear.

The invention claimed is:

1. A drag harness comprising a continuous length of material fixed to itself at two locations to define two fixed length arm loops, each of which is adapted to receive a separate arm of a wearer, and gripping means joined to the arm loops, whereby a rescuer can drag the wearer, if the wearer is lying in a supine position, wherein the arm loops are spaced from each other by a segment of the continuous length of material that extends directly from one of the two locations to the other of the two locations and is less than one-third the length of the continuous length of material defining each arm loop, and the gripping means comprises plural gripping loops formed from one or more additional pieces of material that are distinct from the continuous length of material defining the arm loops, each gripping loop of the gripping means has a fixed length and is sized to receive the hand of a rescuer, wherein each of the gripping loops is formed from an elongate flexible member folded upon itself and attached to a respective end of the continuous length of material.

2. The drag harness of claim 1, wherein the gripping means comprises a pair of gripping loops.

3. The drag harness of claim 1, wherein the plural gripping loops comprise a continuous length of material.

4. A drag harness comprising a continuous length of material fixed to itself at two separate locations to define two arm loops, each location defining one of the arm loops, each of the arm loops being adapted to receive a separate arm of a wearer, the locations spaced from each other by a segment of the continuous length of material that extends directly from one of the locations to the other location and is less than one-third the length of the continuous length of material defining each arm loop; and two gripping loops, each of the gripping loops having a fixed length and sized to receive the hand of a rescuer, the gripping loops being formed from one or more additional pieces of material that are distinct from the continuous length of material defining the arm loops, wherein each of the gripping loops is formed from an elongate flexible member folded upon itself and attached to a respective end of the continuous length of material.

* * * * *